US007396234B2

(12) United States Patent
Sun

(10) Patent No.: US 7,396,234 B2
(45) Date of Patent: Jul. 8, 2008

(54) ELECTRICAL OUTLETS

(75) Inventor: Ke Sun, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,880

(22) Filed: Oct. 17, 2006

(65) Prior Publication Data

US 2008/0020650 A1 Jan. 24, 2008

(30) Foreign Application Priority Data

Jul. 19, 2006 (CN) ..... 2006 1 0061708

(51) Int. Cl.
*H01R 13/44* (2006.01)

(52) U.S. Cl. ..... 439/32; 439/214; 439/652; 439/131

(58) Field of Classification Search ..... 439/32, 439/214, 652, 131, 535
See application file for complete search history.

(56) References Cited

U.S. PATENT DOCUMENTS 4,245,873 A * 1/1981 Markowitz ..... 439/32
5,441,416 A * 8/1995 Gajewski et al. ..... 439/32
5,895,275 A * 4/1999 Harbertson ..... 439/21
6,004,138 A * 12/1999 Harbertson ..... 439/32
6,077,086 A * 6/2000 LaRoche ..... 439/32
6,220,897 B1 4/2001 Maxwell
6,234,812 B1 * 5/2001 Ivers et al. ..... 439/131
6,475,003 B2 * 11/2002 Jones et al. ..... 439/131
6,666,712 B1 * 12/2003 Kramer ..... 439/501
6,854,989 B2 * 2/2005 Milan ..... 439/131
6,872,086 B2 * 3/2005 Milan ..... 439/131

* cited by examiner

*Primary Examiner*—Gary F. Paumen
(74) *Attorney, Agent, or Firm*—Wei Te Chung

(57) ABSTRACT

An electrical outlet includes a main socket unit, and an additional socket unit movably mounted in the main socket unit. The main socket unit includes a power transmitting port, a plurality of sockets, and a first electrical connector. The sockets and the first electrical connector are electrically connected to the power transmitting port. The additional socket unit includes a plurality of sockets, and a second electrical connector electrically connected to the sockets of the additional socket unit. When the additional socket unit extends from within the main socket unit the first electrical connector of the main socket unit is electrically connected to the second electrical connector of the additional socket unit.

17 Claims, 4 Drawing Sheets

ELECTRICAL OUTLETS

1. Field of the Invention

The invention relates to electrical outlets. In particular, the present invention relates to an electrical outlet incorporating an additional socket unit according to need.

2. Description of Related Art

A conventional electrical outlet with a plurality of sockets is provided for electrical apparatus. In order to provide power to a computer system and related computer peripheral apparatus such as monitors, printers, modems, speakers, scanners, digital cameras, etc., much more sockets may be necessary. Because the amount of sockets in the electrical outlet is fixed, it cannot be adjusted to satisfy practical requirements. For example, sometimes the sockets are too few, and sometimes the sockets are too many, which wastes space.

What is needed is an electrical outlet having an additional socket unit which can be adjusted according to need.

SUMMARY OF THE INVENTION

An exemplary electrical outlet includes a main socket unit, and an additional socket unit movably mounted in the main socket unit. The main socket unit includes a power transmitting port, a plurality of sockets, and a first electrical connector. The sockets and the first electrical connector are electrically connected to the power transmitting port. The additional socket unit includes a plurality of sockets, and a second electrical connector electrically connected to the sockets of the additional socket unit. When the additional socket unit extends from within the main socket unit the first electrical connector of the main socket unit is electrically connected to the second electrical connector of the additional socket unit.

Other advantages and novel features will become more apparent from the following detailed description when taken in conjunction with the accompanying drawing, in which:

DETAILED DESCRIPTION OF THE INVENTION

Figure 1:
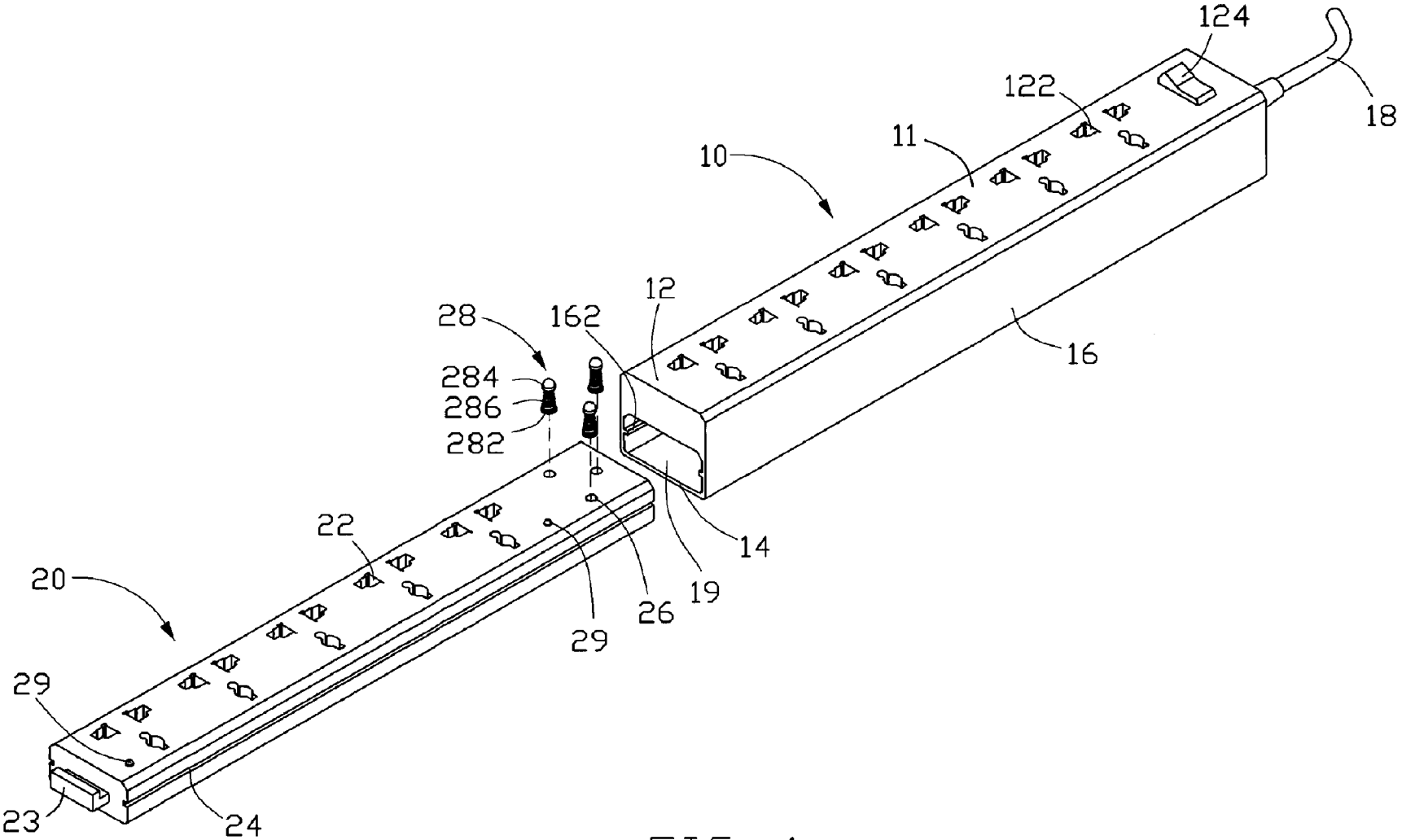
FIG. 1 is an exploded, isometric view of an electrical outlet in accordance with a preferred embodiment of the present invention, the electrical outlet has a main socket unit and an additional socket unit.

Referring to FIG. 1, an electrical outlet in accordance with a preferred embodiment of the present invention includes a main socket unit 10, and an additional socket unit 20.

The main socket unit 10 has an elongated housing 11. The housing 11 includes a top plate 12, a bottom plate 14, and a pair of opposing side plates 16. A power transmitting port including a cable 18 with a plug (not shown) extends from an end of the housing 11 for connecting to a power supply. A plurality of sockets 122 is defined in the top plate 12 and electrically connected to the cable 18 via internal wires (not shown). The sockets 122 can be designed to fit different electric plugs in different countries. A switch 124 is set on the top plate 12 for opening or closing a circuit between the cable 18 and the sockets 122.

The main socket unit 10 defines a receiving space 19 enclosed by the top plate 12, the bottom plate 14, and the side plates 16, with an opening at the other end of the housing 11, for receiving the additional socket unit 20. Two rails 162 protrude toward each other from inside surfaces of the two side plates 16.

Figure 2:
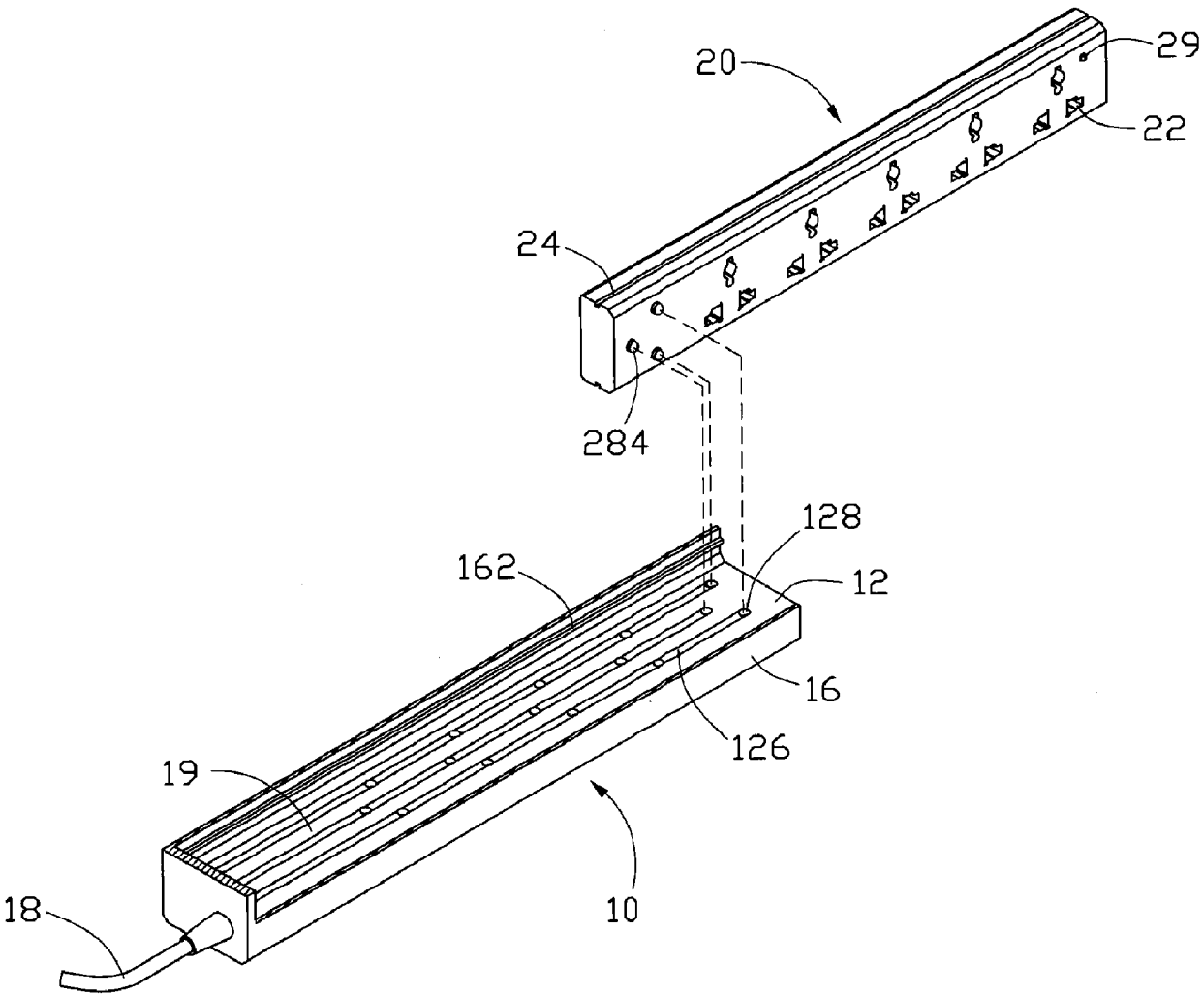
FIG. 2 is similar to FIG. 1, but viewed from another aspect.

Referring also to FIG. 2, three sliding grooves 126 are defined in a bottom surface of the top plate 12 and parallel to a sliding direction of the additional socket unit 20. The main socket unit 10 includes a first electrical connector for electrically connecting to the sockets 122. In this embodiment the first electrical connector are three ball holes 128 set interval along the sliding grooves 126. The ball holes 128 are electrically connected to the cable 18.

The additional socket unit 20 has an elongated body mating with the receiving space 19. A plurality of sockets 22 is defined in a top of the additional socket unit 20. Two sliding slots 24 are defined in two sidewalls of the additional socket unit 20 corresponding to the two rails 162 of the main socket unit 10. Three apertures 26 are defined in the top of the additional socket unit 20 near an end of the additional socket unit 20, corresponding to the three ball holes 128 of the main socket unit 10. A handle 23 is set at the other end of the additional socket unit 20.

The additional socket unit 20 includes a second electrical connector for electrically connecting to the sockets 22 of the additional socket unit 20. An amount of the sliding grooves 126 can be changed according to configuration of the sockets 22 of the additional socket unit 20, that is, if each of the sockets 22 has no ground terminal, the amount of the sliding grooves 126 can be two.

In this embodiment the second electrical connector are three elastic members 28 snapped into the corresponding three apertures 26 of the additional socket unit 20. Each of the elastic members 28 includes a circular spring clip 282, a conducting ball 284, and a spring 286 electrically connected to the circular spring clip 282 and the conducting ball 284. The circular spring clips 282 of the elastic members 28 are engaged in the corresponding apertures 26 of the additional socket unit 20 for electrically connecting to the sockets 22 of the additional socket unit 20. The conducting balls 284 of the elastic members 28 extend out of the top of the additional socket unit 20. An indicator light 29 is set on the top of the additional socket unit 20. When the sockets 22 of the additional socket unit 20 are connected to power, the indicator light 29 lights up.

Figure 3:
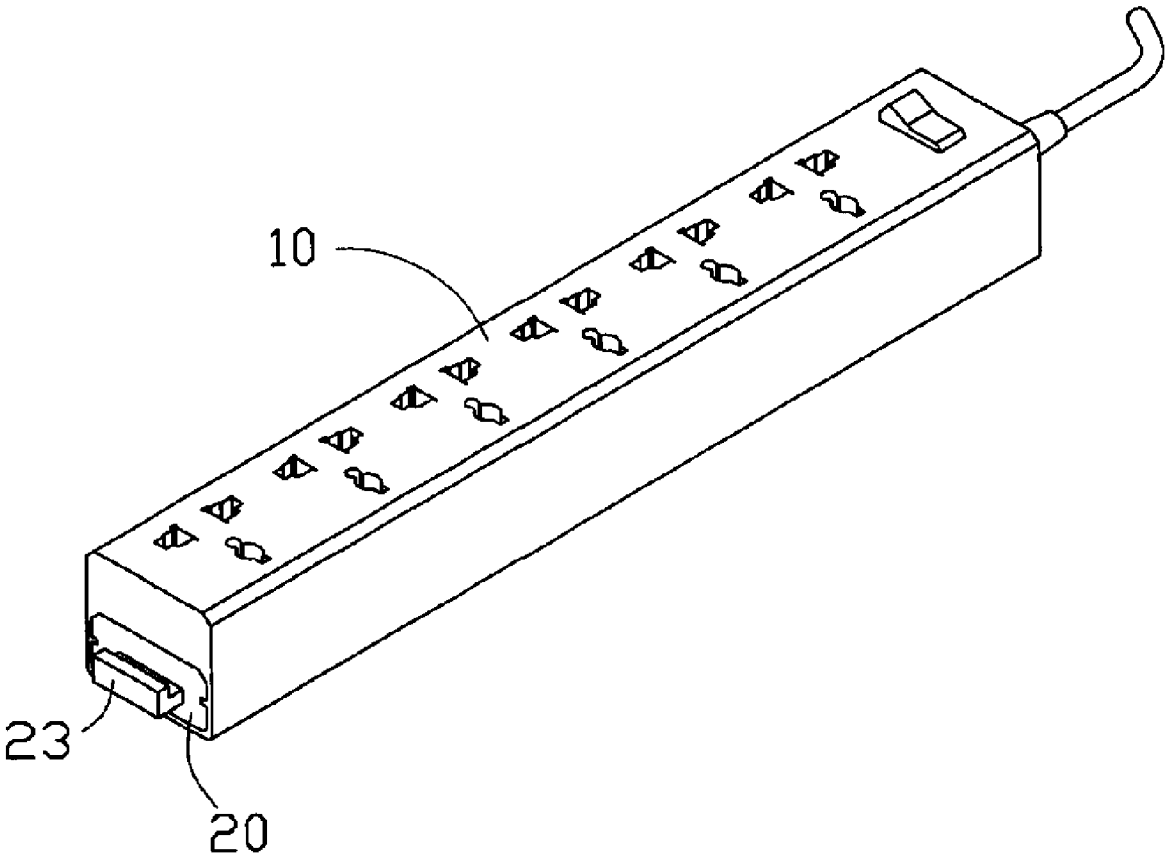
FIG. 3 is an assembled view of FIG. 1, with the additional socket unit received in the main socket unit in a retracted position.

Referring to FIG. 3, in assembly, the two rails 162 of the main socket unit 10 are engaged in the two sliding slots 24 of the additional socket unit 20 to mount the additional socket unit 20 in the main socket unit 10. At this time, the conducting balls 284 of the elastic members 28 are received in the corresponding sliding grooves 126 of the main socket unit 10. The additional socket unit 20 is received in the receiving space 19 of the main socket unit 10 by pushing the socket unit 20 into the main socket unit 10 to a retracted position.

Figure 4:
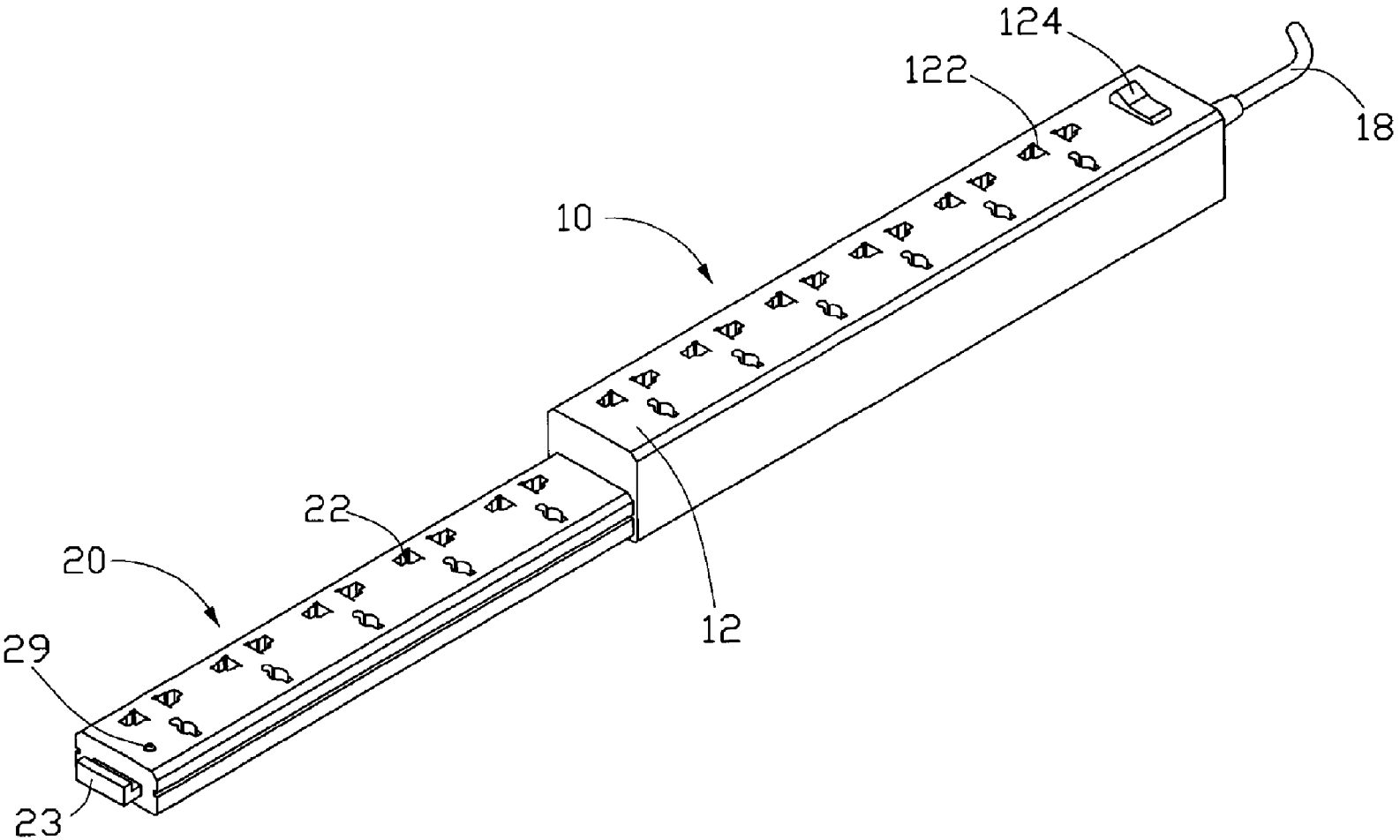
FIG. 4 is similar to FIG. 3, but showing the additional socket unit in an extended position.

Referring to FIG. 4, when more sockets are desired, the additional socket unit 20 is drawn out of the main socket unit 10 by pulling the handle 23. The conducting balls 284 of the elastic members 28 slide along the sliding grooves 126 of the main socket unit 10 until the conducting balls 284 snappingly engage in the corresponding ball holes 128 of the main socket unit 10. Thus, the socket unit 20 is in an extended position. The additional socket unit 20 can be positioned at variable extended positions via the conducting balls 284 engaging in variable ball holes 128 of the main socket unit 10.

In the extended positions, because the ball holes 128 are electrically connected to the cable 18 and the conducting balls 284 are electrically connected to the sockets 22 of the additional socket unit 20 via the circular spring clip 282 of the elastic members 28, the sockets 22 of the additional socket unit 20 are electrically connected to the cable 18. The indicator light 29 lights up when the switch 124 is turned on, and the sockets 22 of the additional socket unit 20 are provided with power from the cable 18 and are thereby available.

The additional socket unit 20 can be mounted in the main socket unit 10 by different fixing means. For example, two guiding grooves are defined in the two side plates 16 of the main socket unit 10 and two rails protrude out from the two sidewalls of the additional socket unit 20. In this way the additional socket unit 20 can also slide into or out of the receiving space 19 of the main socket unit 10.

Alternatively, the additional socket unit 20 can be rotatably and pivotably connected with the main socket unit 10 by articulated means, so that the additional socket unit 20 also can be received in or moved out of the main socket unit 10.

In these embodiments, the number of available sockets of the electrical outlet can be adjusted as needed by moving the additional socket unit 20 relative to the main socket unit 10 between the retracted position and variable extended positions.

It is to be understood, however, that even though numerous characteristics and advantages of the preferred embodiments have been set forth in the foregoing description, together with details of the structures and functions of the embodiments, the disclosure is illustrative only, and changes may be made in detail, especially in matters of shape, size, equivalent material and arrangement of parts within the principles of the invention to the full extent indicated by the broad general meaning of the terms in which the appended claims are expressed.

What is claimed is:

1. An electrical outlet comprising:

a main socket unit including a power transmitting port, a plurality of sockets and a first electrical connector, the sockets and the first electrical connector being electrically connected to the power transmitting port; and an additional socket unit movably mounted in the main socket unit, the additional socket unit including a plurality of sockets, and a second electrical connector electrically connected to the sockets of the additional socket unit;

wherein when the additional socket unit moves out of the main socket unit, the first electrical connector of the main socket unit is electrically connected to the second electrical connector of the additional socket unit.

2. The electrical outlet as claimed in claim 1, wherein the main socket unit includes an elongated housing comprising a top plate, a bottom plate, and a pair of opposing side plates, cooperatively defining a receiving space therebetween, the receiving space open to outside at an end of the housing for receiving the additional socket unit.

3. The electrical outlet as claimed in claim 2, wherein the power transmitting port includes a cable extending from an opposite end of the housing for connecting to a power supply, the sockets of the main socket unit are defined in the top plate and electrically connected to the cable.

4. The electrical outlet as claimed in claim 2, wherein two rails protrude toward each other from inside surfaces of the two side plates of the main socket unit, two sliding slots are defined in two sidewalls of the additional socket unit corresponding to the two rails of the main socket unit, the additional socket unit being capable of sliding into the receiving space of the main socket unit via the two rails sliding in the two sliding slots of the additional socket unit respectively.

5. The electrical outlet as claimed in claim 2, wherein three sliding grooves are defined in a bottom surface of the top plate parallel to a sliding direction of the additional socket unit, the first electrical connector comprises ball holes set interval along the sliding grooves, the ball holes are electrically connected to the power transmitting port.

6. The electrical outlet as claimed in claim 5, wherein three apertures are defined in the additional socket unit near an end of the additional socket unit, the second electrical connector comprises three elastic members engaged in the corresponding three apertures of the additional socket unit for electrically connecting the sockets of the additional socket unit to the power transmitting port via the first electrical connector.

7. The electrical outlet as claimed in claim 6, wherein each of the elastic members includes a circular spring clip engaged in the corresponding apertures of the additional socket unit for electrically connecting to the sockets of the additional socket unit, a conducting ball for snappingly engaging in the ball holes of the main socket unit, and a spring electrically connected to the circular spring clip and the conducting ball.

8. An electrical outlet comprising:

a main socket unit including a housing, a power transmitting port connecting to an end of the housing, and a plurality of sockets electrically connected to the power transmitting port; and an additional socket unit including a plurality of sockets moveably received in the housing;

wherein the additional socket unit is capable of being moved out of the housing of the main socket unit and positioned at variable positions according to need, when the additional socket unit is moved out of the housing of the main socket unit, the sockets of the additional socket unit are electrically connected to the power transmitting port, the main socket unit includes a first electrical connector electrically connected to the power transmitting port, the additional socket unit includes a second electrical connector electrically connected to the sockets of the additional socket unit, when the additional socket unit is moved out of the housing of the main socket unit, the first electrical connector is electrically connected to the second electrical connector.

9. The electrical outlet as claimed in claim 8, wherein the housing comprise a top plate, a bottom plate, and a pair of opposing side plates, cooperatively defining a receiving space therebetween, the receiving space communicates with outside at an opposite end of the housing for receiving the additional socket unit.

10. The electrical outlet as claimed in claim 8, wherein the power transmitting port includes a cable for connecting to a power supply, the sockets of the main socket unit are defined in the top plate and electrically connected to the cable.

11. The electrical outlet as claimed in claim 8, wherein two rails protrude toward each other from inside surfaces of the two side plates of the main socket unit, two sliding slots are defined in two sidewalls of the additional socket unit corresponding to the two rails of the main socket unit, the two sliding slots of the additional socket slide along the two rails of the main socket unit.

12. The electrical outlet as claimed in claim 8, wherein three sliding grooves are defined in a bottom surface of the top plate parallel to a sliding direction of the additional socket unit, the first electrical connector comprises ball holes set interval along the sliding grooves, the ball holes are electrically connected to the power transmitting port.

13. The electrical outlet as claimed in claim 12, wherein three apertures are defined in the additional socket unit near an end of the additional socket unit, the second electrical connector comprises three elastic members engaged in the corresponding three apertures of the additional socket unit for electrically connecting the sockets of the additional socket unit to the power transmitting port via the first electrical connector.

14. The electrical outlet as claimed in claim 13, wherein each of the elastic members includes a circular spring clip engaged in the corresponding apertures of the additional socket unit for electrically connecting to the sockets of the additional socket unit, a conducting ball for snappingly engaging in the ball holes of the main socket unit, and a spring electrically connected to the circular spring clip and the conducting ball.

15. An electrical outlet comprising:

a main socket unit comprising a housing, a power transmitting port connecting to an end of the housing configured for receiving power from a power source, and a plurality of sockets electrically connected to the power transmitting port; and an additional socket unit including a plurality of sockets, wherein the additional socket unit is moveably received in the housing and moveable between a retracted position at which the additional socket unit is substantially received in the housing and the sockets of the additional socket unit are unavailable and an extended position at which the additional socket unit is moved out of the housing and at least one of the sockets of the additional socket unit is available, wherein the additional socket unit is moveable relative to the main socket unit to variable extended positions so that variable sockets of the additional socket unit are available, the main socket unit comprises a plurality of groups of contacting points electrically connected to the power transmitting port, and the additional socket unit includes an electrical connector electrically connected to the sockets of the additional socket unit, the groups of contacting points arranged with interval corresponding to the extended positions, the electrical connector being capable of selectively electrically connecting to one of the groups of contacting points.

16. The electrical outlet as claimed in claim 15, wherein apertures are defined in the additional socket unit, the electrical connector comprises elastic members securely engaged in the corresponding apertures of the additional socket unit for snappingly engaging with the selected group of contacting points to thereby electrically connect the sockets of the additional socket unit to the power transmitting port.

17. The electrical outlet as claimed in claim 15, wherein the housing comprises a receiving space enclosed except one end via which the additional socket unit is capable of sliding into the receiving space.

* * * * *